US005404872A

United States Patent [19]

Choi

[11] Patent Number: 5,404,872

[45] Date of Patent: Apr. 11, 1995

[54] SPLASH-GUARD FOR SNORKEL TUBES

[75] Inventor: Moon Y. Choi, Placentia, Calif.

[73] Assignee: Under Sea Industries, Inc., Del.

[21] Appl. No.: 84,486

[22] Filed: Jul. 1, 1993

[51] Int. Cl.[6] ..... B63C 11/16

[52] U.S. Cl. ..... 128/201.11; 128/201.27

[58] Field of Search ..... 128/201.11, 201.26, 128/201.27, 201.28, 200.29

[56] References Cited

U.S. PATENT DOCUMENTS

| | | | |
|---|---|---|---|
| 3,908,647 | 9/1975 | Taunton | 128/201.11 |
| 4,071,024 | 1/1978 | Blanc | 128/201.11 |
| 4,793,341 | 12/1988 | Arasmith | 128/201.11 |
| 5,143,059 | 9/1992 | Delphia | 128/201.11 |
| 5,267,556 | 12/1993 | Feng | 128/201.11 |

*Primary Examiner*—Edgar S. Burr
*Assistant Examiner*—William J. Deane, Jr.
*Attorney, Agent, or Firm*—Leonard Tachner; Flam & Flam

[57] ABSTRACT

A snorkel top device which may be readily added to an existing snorkel tube for preventing the inadvertent entry of splash water into the top of the tube by providing a flap which tends to deflect splash water so that it exits the snorkel top device without entering the tube attached thereto. The most significant feature of the invention is that the snorkel top device provides a simple and effective guard against entry of splashed water into the top of the snorkel tube and yet constitutes a unitary, relatively inexpensive structure which has no moving parts, no valves and which provides an aesthetically pleasing addition to existing snorkel tubes.

12 Claims, 5 Drawing Sheets

SPLASH-GUARD FOR SNORKEL TUBES

BACKGROUND OF THE INVENTION

1. Field of the Invention

The present invention relates generally to the field of snorkeling equipment and more specifically to a splash-guard device which may be optionally added to an existing snorkel tube at the top end thereof, for significantly reducing the entry of water such as from wave splashing and the like.

2. Prior Art

The ideal snorkel would permit the free-flow of air into and out of the snorkel tube through the top thereof, while preventing the entry of water therein and simultaneously permitting the user to blow water out of the tube, in the event some water enters the interior of the snorkel. One of the reasons for water entry into the top of the snorkel tube is the splashing effect, due to wave action or merely the disruption of the water surface by action of the snorkeler. In any case, even when the snorkeler scrupulously avoids allowing the top open end of the snorkel tube to fall below the surface of the water, water is nevertheless likely to enter the top of the tube and interfere with the snorkeler's breathing and require that he or she blow or eject the water out of the snorkel in order to resume normal breathing through the snorkel tube. The prior art is rife with attempts to overcome this problem, namely, a variety of devices disclosed as means for preventing the entry of splashed water through the top of the snorkel tube during the use thereof. Unfortunately, all such prior art attempts known to the applicant herein, suffer from one or more disadvantages which reduce the likelihood for commercial viability. By way of example, in many such prior art disclosures, the structures used to prevent water entry into the top of the snorkel tube, while still permitting air flow both into and out of the top of the snorkel tube are entirely too cumbersome, complex and expensive to produce. Some involve the use of various types of valves which are inherently complicated and involve costly manufacturing processes. Others are so cumbersome in their structure and appearance that they significantly detract from the aesthetic aspects of the snorkel tube and are thus commercially unacceptable. Furthermore, in all such prior art disclosures, the device disclosed for preventing the entry of splashed water into the top of the snorkel tube is typically provided as an integral portion of the snorkel tube, thus requiring the purchasing public to buy a new snorkel in order to incorporate the splashed water blocking feature.

Typical examples of such prior art disclosures may be found in the following patents.

| | |
|---|---|
| 2,814,292 | Girden |
| 2,815,751 | Ferraro |
| 2,888,010 | Girden |
| 3,141,469 | Stradella |
| 3,345,984 | Katehis |
| 3,721,236 | Bardehle |
| 3,768,504 | Rentsch, Jr. |
| 4,610,246 | Delphia |
| 4,793,341 | Arasmith |
| 4,805,610 | Hunt |
| 5,117,817 | Lin |

U.S. Pat. No. 2,815,751 to Ferraro is directed to a breathing valve for a submarine mask. The submarine mask includes an oscillating arm 1 pivotally mounted on a union T of a breathing tube and having a disk-shaped member 4 attached to the free end thereof, and an arm 5 pivotally mounted to the union T and having a buoyant body 6 attached to the free end thereof. The closing member 4 is made of a material heavier than water. Under normal conditions, the buoyancy of the body 6 forces the closing member 4 outward, thereby closing the breathing tube. As shown in FIG. 5, when the position of the breathing tube is inverted, the closing member 4, due to its own weight, closes the orifice of the breathing tube.

U.S. Pat. No. 3,768,504 to Rentsch, Jr. is directed to a check valve for use with a snorkel type breathing tube. The snorkel includes a tube 50 having a conventional mouthpiece attached to the lower end of the tube, an annular member 20 attached to the upper end or free end of the tube 50, and a check valve having a ball 12 adapted to be seated on one end of the annular member. The ball 12 is weighted so as to be neutrally buoyant when submerged in water and is joined to the angle member 20 by a spring 40 which exerts a light biasing force on the ball causing it to sealingly engage a valve seat defined at one end of the annular member 20.

U.S. Pat. No. 3,141,469 to Stradella is directed to a diving mask. The diving mask includes a breathing pipe 1 provided with a cage 2 on the upper end of the breathing pipe for receiving and guiding the valve member 3, a pivotal fork assembly 7–9 mounted to the cage 2, and a float body 11 mounted to the free end of the fork assembly 7–9. The portion of the float body 11 is interchangeable, while the remainder is solid and flat. As shown in FIG. 1, the float body 11 is movable between two positions for opening and closing the bottom member 3.

U.S. Pat. No. 2,814,292 to Girden is directed to a breathing apparatus. The breathing apparatus 10 includes a breathing tube 12 having a mouthpiece attached to its lower end, a splash guard 13 attached to the upper end of the breathing tube, and a float control valve 16 provided at the upper end of the breathing tube 12 and automatically operable to seal the latter in response to submerging of the upper end of the breathing tube.

It will be seen therefore that there is a continuing need to provide a device which may be readily added to existing snorkel tubes and which is comprised of a simple and inexpensively produced structure which does not significantly detract from the overall aesthetic appearance of the snorkel.

SUMMARY OF THE INVENTION

The present invention meets the aforementioned need by providing a snorkel top device which, in two disclosed preferred embodiments, may be readily added to an existing snorkel tube for preventing the inadvertent entry of splash water into the top of the tube by providing a flap which tends to deflect splash water so that it exits the snorkel top device without entering the tube attached thereto. Each such embodiment disclosed herein comprises a unitary structure, preferably made of a plastic material which may be readily injection molded for low cost fabrication and which has no valves or other moving parts which would otherwise add to the cost and detract from the aesthetic appearance of the combined snorkel and snorkel top device. In fact, in the preferred embodiments disclosed herein, it will be seen that the overall shape and structure of the snorkel top device of the present invention is designed to compliment, rather than detract from the aesthetic appearance of the snorkel. In one embodiment continuing lines of at least one surface of the snorkel tube are preserved, thus providing an attractive addition that is relatively low in cost and easy to install into the existing snorkel tube, without any special tools or other equipment.

One of the preferred embodiments disclosed herein is referred to as a female version which is designed to receive the snorkel tube top in its interior and completely surround the exterior surface of the snorkel tube at the top thereof. The other preferred embodiment disclosed herein is referred to herein as the male version and has a snorkel tube interface portion which is installed into the interior surface of the top of the snorkel tube in a manner which will be disclosed hereinafter in more detail. In each case, the most significant feature of the invention is that the snorkel top device provides a simple and effective guard against entry of splashed water into the top of the snorkel tube and yet constitutes a unitary, relatively inexpensive structure which has no moving parts, no valves and which provides an aesthetically pleasing addition to existing snorkel tubes, thereby obviating a prior art requirement for purchasing an entirely new snorkeling device.

OBJECTS OF THE INVENTION

It is therefore a principal object of the present invention to provide a splash-guard device for addition to existing snorkel tubes, the device being configured to significantly prevent the entry of splash water into the top of a snorkel tube.

It is another object of the present invention to provide a snorkel top device which is adapted to mate with the top portion of a snorkel tube for increasing the resistance to inadvertent entry of splash water therein, by re-routing such water outside the snorkel tube.

It is still an additional object of the present invention to provide a snorkel attachment device for reducing the entry of splash water into the interior of the snorkel, the device being made of a unitary structure having no moving parts or valves that would otherwise reduce reliability and increase fabrication costs.

It is still an additional object of the present invention to provide a device for attachment to the upper portion of an existing snorkel tube for reducing the entry of splash water into the interior of the tube, the device being configured for simple installation onto the tube and for minimum detrimental impact upon the aesthetic appearance of the tube.

It is still an additional object of the invention to provide a snorkel having an integral splash guard for diverting splash water from a main channel in communication with the snorkel mouthpiece to a separate channel open to ambient.

BRIEF DESCRIPTION OF THE DRAWINGS

The aforementioned objects and advantages of the present invention, as well as additional objects and advantages thereof, will be more fully understood herein as a result of a detailed description of preferred embodiments when taken in conjunction with the following drawings in which.

DETAILED DESCRIPTION OF A PREFERRED EMBODIMENTS

Figures 1, 2:
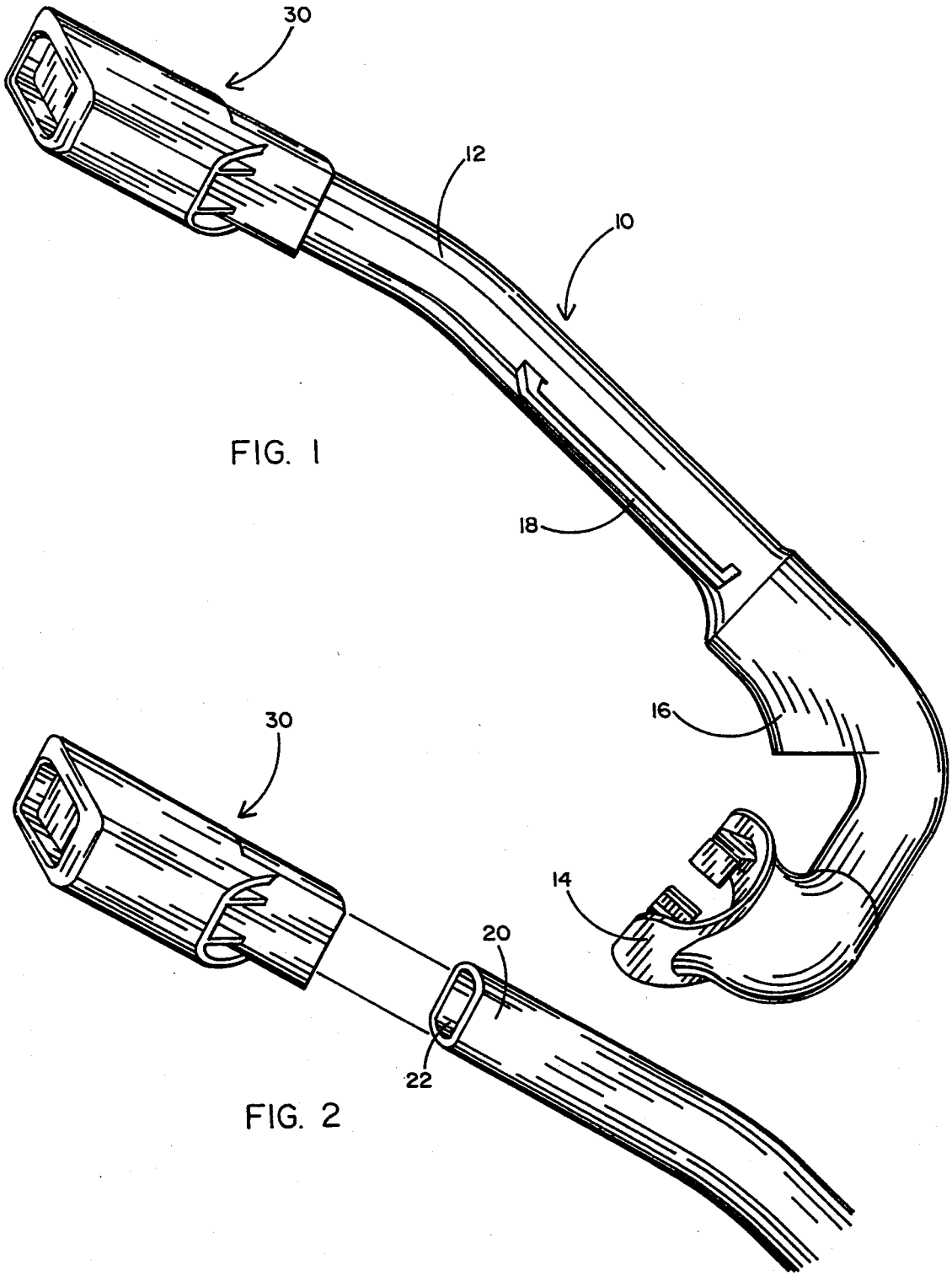
FIG. 1 is a three dimensional view of a first embodiment of the present invention shown installed at the top of an existing snorkel tube.
FIG. 2 is a view similar to that of FIG. 1, but showing the present invention detached from the snorkel tube top.
Figure 5:
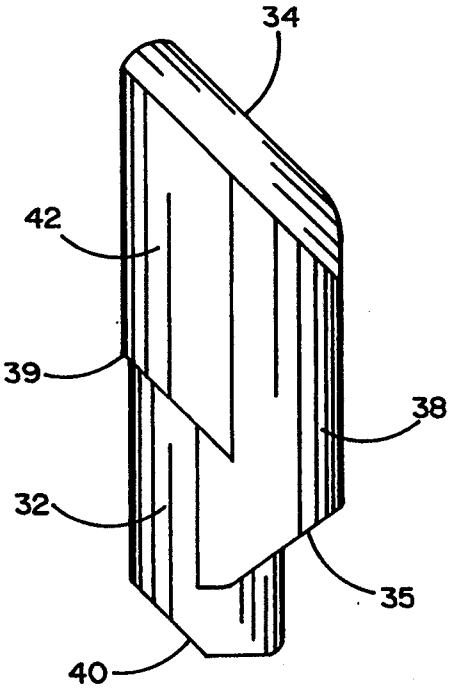
FIG. 5 is a side elevational view of the first embodiment of the present invention.
Figure 4:
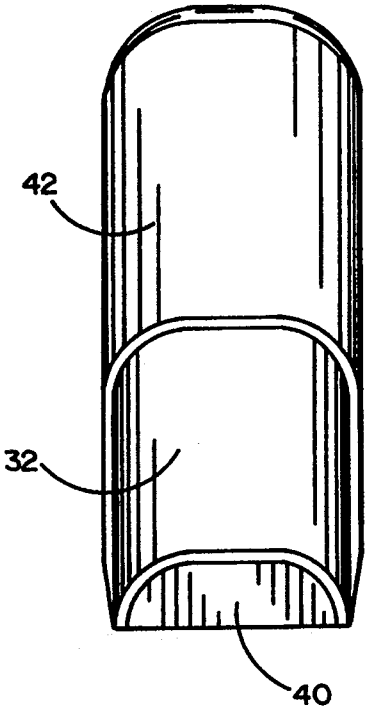
FIG. 4 is a rear elevational view of the first embodiment of the present invention.
Figure 3:
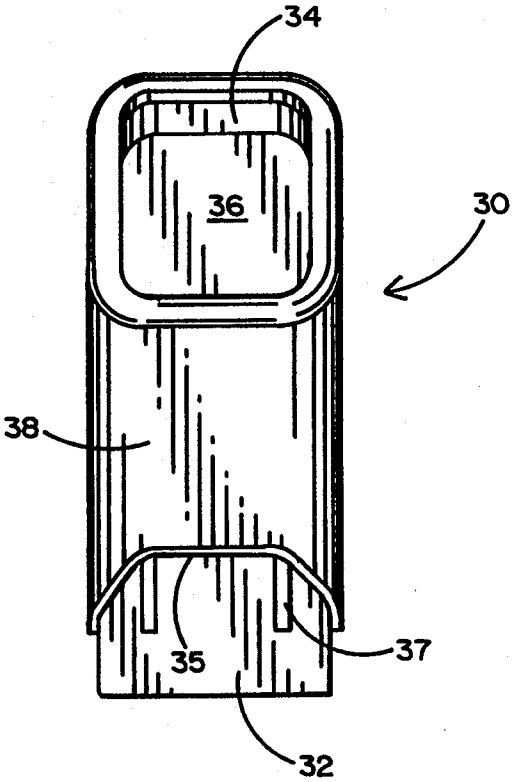
FIG. 3 is a front elevational view of the first embodiment to the present invention.
Figure 8:
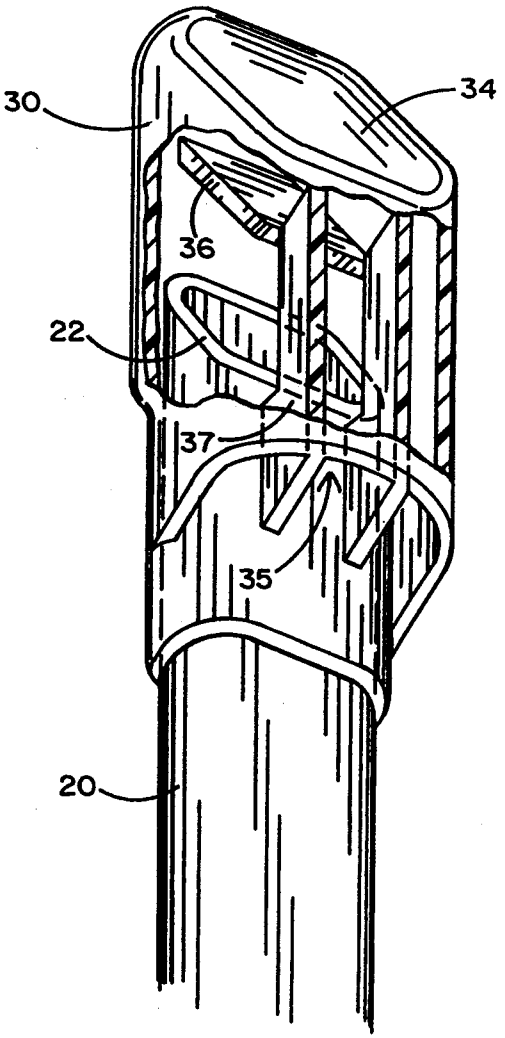
FIG. 8 is a three dimensional partially cut-away, view of the first embodiment of the present invention shown installed on a snorkel tube.
Figure 7:
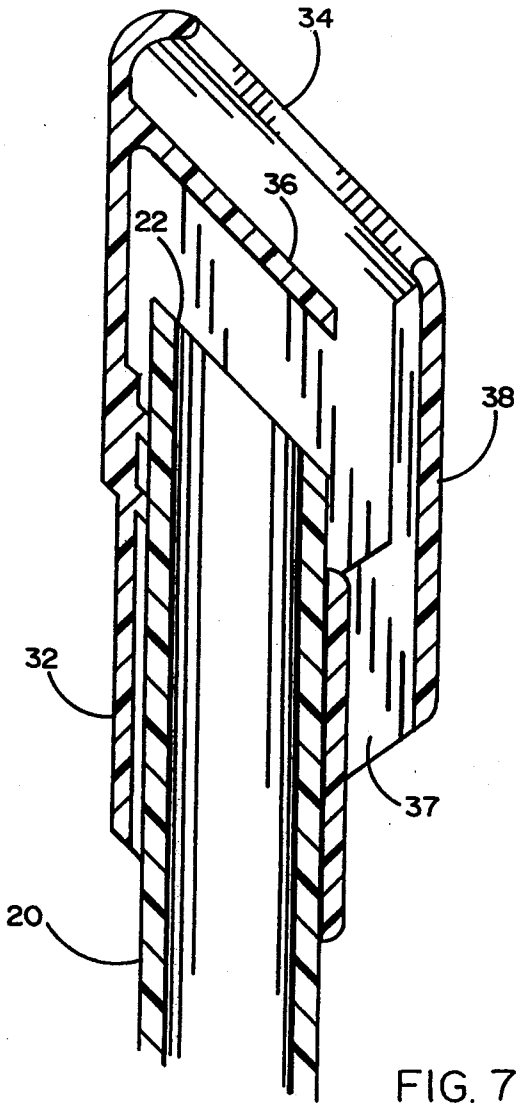
FIG. 7 is a view similar to that of FIG. 6, but showing in cross section, the first embodiment of the present invention attached to the exterior top of a snorkel tube.
Figure 6:
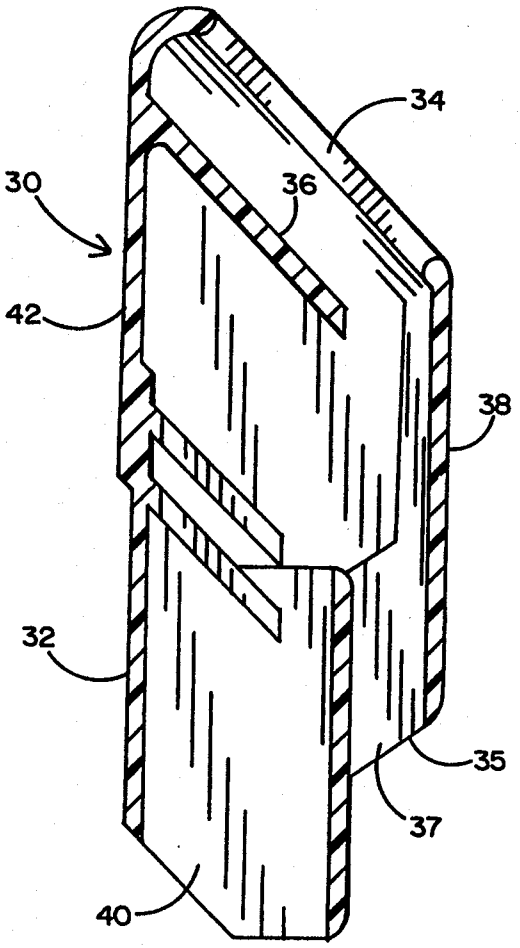
FIG. 6 is a cross-sectional side view of the first embodiment of the present invention.
Figure 11:
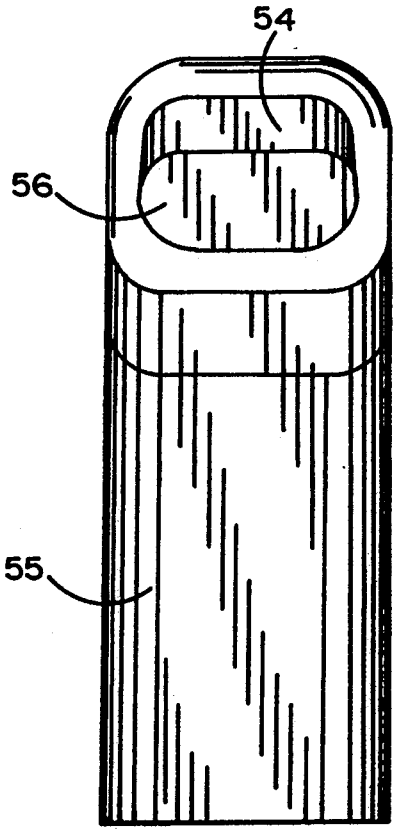
FIG. 11 is a front elevational view of the second embodiment of the present invention.
Figure 10:
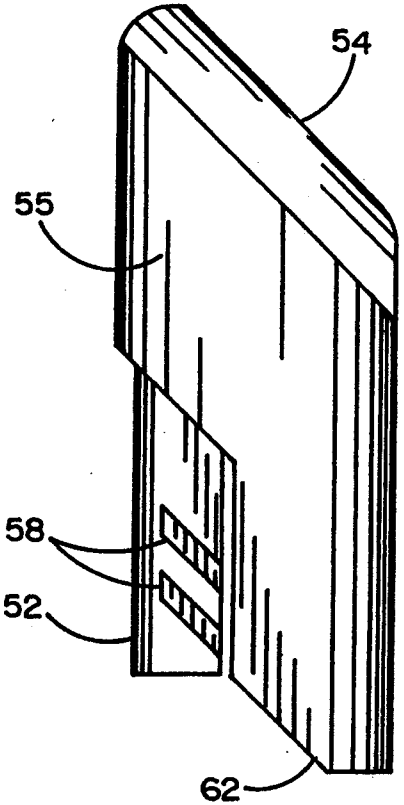
FIG. 10 is a side elevational view of the second embodiment of the present invention.
Figure 9:
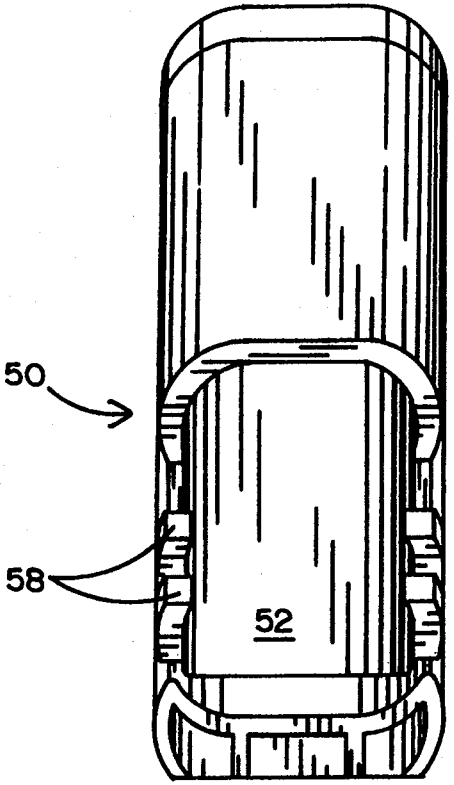
FIG. 9 is a rear elevational view of a second embodiment of the invention.

Referring now to the accompanying figures, it will be seen that the present invention is designed to mate with an existing snorkel 10, of the type having a snorkel tube 12 connected to a mouthpiece 14 in a well-known manner. The snorkel tube 12, shown in FIG. 1 also provides a valve 16 and a mask attachment bracket 18, the former being designed to increase the resistance to the accumulation of water near the mouthpiece 14, and the latter providing an interface for attachment to a mask typically worn when a snorkel tube is used. However, it will be understood that the present invention may be used with a variety of different snorkel tube configurations, including those which do not have valves or mask attachment brackets or which have such components in other locations relative to the structure of the snorkel.

As seen in FIG. 2, a first embodiment of the present invention comprises a deflection device 30 which is designed to mate with the upper end 20 of the snorkel tube 12, adjacent the aperture 22 at the top of the snorkel tube. The deflection device 30 is a female version comprising the first embodiment of the present invention and may be seen in more detail in FIGS. 3–8.

Turning now to the latter mentioned figures, it will be seen that the deflection device 30 comprises a snorkel interface 32 is configured to conform generally with the shape of the upper end 20 of the snorkel 10 and to surround the top end 20 thereof in press-fit engagement therewith, extending the snorkel tube 12 by a portion of the length of the deflection device 30. Accordingly, there is provided in the deflection device 30, a body or housing 39, having front surface 38 and a rear surface 42 and defining a snorkel receiving area 40. Deflection device 30 also has an aperture 34 at the top thereof which, when the deflection device 30 is installed on the snorkel 10, becomes a top aperture of the combined snorkel and deflection device. Also seen in the accompanying figures, specifically FIGS. 3, 6, 7 and 8, is a deflector or flap 36 which is positioned in displaced orientation from the aperture 34 and is substantially parallel to the plane of the aperture and of the same general shape and size, whereby to extend over the aperture 22 of the snorkel tube 12, but also be displaced therefrom, as seen best in FIG. 7. As seen further in FIG. 7, the deflector or flap 36 is extended from the interior surface of the body 39 of the deflection device 30 in a cantilevered fashion at an angle which is generally parallel to the plane of the aperture 34 and diagonal to the axis of the upper end of 20 of the snorkel tube 12. Thus, water entering the aperture 34 is redirected with respect to the top aperture 22 of the snorkel tube 20 in a direction which falls into a separate deflection channel or exit area 35, formed between the front surface 38 of the deflection device 30 and the snorkel tube 20 by at least two strakes 37.

Thus, it will be seen that the deflection device 30 of the present invention may be considered as having two channels, namely a first channel which is in fluid communication with the installed snorkel tube top, but which is partially blocked by a deflector or flap which is oriented for redirecting incoming splash water into a second channel, the latter being positioned adjacent the deflector or flap at one end and opening to ambient at the other end to redirect the water outside the deflection device and also outside the snorkel tube. The deflection device 30 of FIGS. 3 through 8 is a female version of the present invention, in view of the fact that the deflection device 30 is designed to receive the snorkel tube, which is entirely surrounded along its exterior surface at the snorkel receiving area 40 by the snorkel interface 32. A second embodiment of the present invention, which is configured as a male version thereof, is shown in FIGS. 9 through 14 to which reference will now be made.

Figure 14:
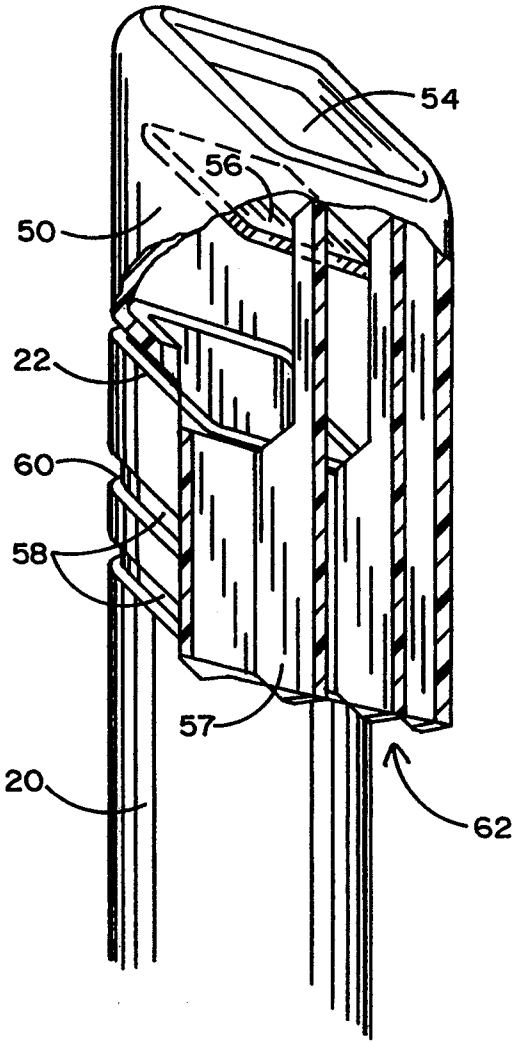
FIG. 14 is a three-dimensional partially sectioned view of the second embodiment of the invention shown installed on a snorkel tube.
Figure 13:
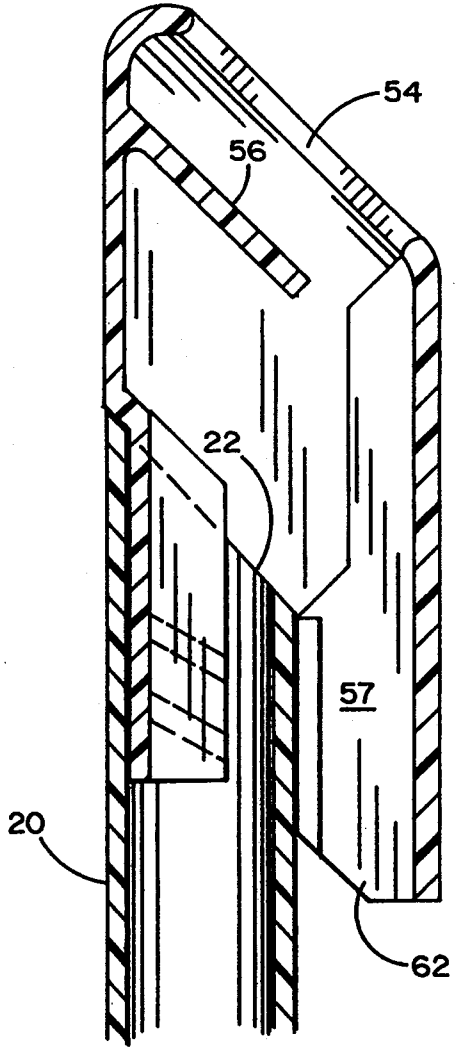
FIG. 13 is a side cross-sectional view of the second embodiment shown installed on the top of a snorkel tube.
Figure 12:
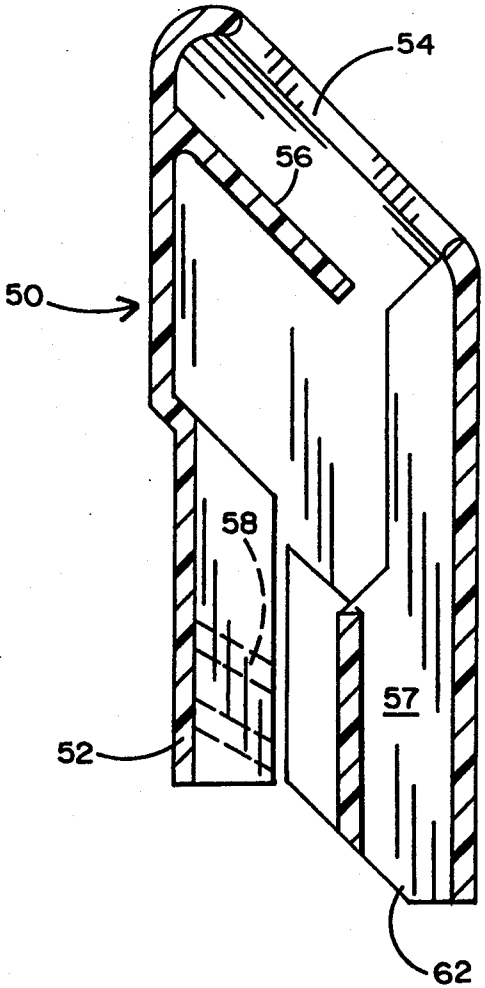
FIG. 12 is a side cross-sectional view of the second embodiment of the present invention.

As shown in FIGS. 9 through 14, the deflection device 50 of the present invention is generally of the same shape of the first embodiment thereof, shown in FIGS. 3 through 8, but comprises an attachment protrusion 52, which is designed to interface with the interior surface of the snorkel tube 12, at the upper end 20 thereof. At least one surface of the snorkel tube merges with the exterior surface of the deflection device, as shown best in FIG. 13. The attachment protrusion 52 is preferably provided with a pair of attachment members 58, which as seen best in FIG. 14, are designed to interface in interlocking engagement with a pair of attachment slots 60 in the snorkel tube in order to mechanically secure the deflection device 50 to the snorkel tube. In all other respects, the deflection device 50 is virtually identical to the deflection device 30 in that it comprises an aperture 54, leading into the interior of the body 55. There is also provided a deflector or flap 56 which is positioned in spaced relation to the aperture 54 and is generally parallel to the plane of the aperture, thus being oriented in a diagonal direction relative to the axis of the upper end 20 of the snorkel tube 12. Just as in the first embodiment of the invention, in this second embodiment, a pair of strakes 57 define a distinct deflection channel to permit the water impacting the deflector 56 to be directed through an exit area 62 to ambient, outside the deflection device 50 and the snorkel tube 12.

Thus, it will now be seen that the present invention comprises a deflection device that may be added to an existing snorkel tube for significantly reducing the amount of splash water that enters the top aperture of the tube and which would otherwise enter the tube and interfere with the breathing of the snorkeler. Two alternative embodiments of the invention have been disclosed herein, a male version and a female version. Such gender designation is based upon whether the interconnection with the snorkel tube is on the exterior of the tube or in the interior of the tube. In both such versions, a body is provided having two separated channels, one such channel is in fluid communication with the top portion of the snorkel tube and provides a deflector or flap which is spaced from the snorkel tube, but positioned relative to the axis thereof, to prevent water from reaching the top of the snorkel tube. The deflector instead is oriented at an angle which is inclined relative to the axis of the snorkel tube, to force incident water to roll toward the second channel, which directs the water out to ambient through an exit aperture, thus bypassing the snorkel tube and minimizing the entry of water therein. Both of the preferred embodiments of the invention disclosed herein, comprise unitary structures, preferably made of injection molded plastic material, thus obviating the expensive fabrication of multiple component devices, as well as devices having moving parts and the like.

Those having skill in the art to which the present invention pertains, will now as a result of the applicant's teaching herein, perceive various modifications and additions which may be made to the invention. By way of example, the specific shape and dimension of the deflection device shown herein may be readily altered to accommodate virtually any shape and size snorkel tube, it being understood that the snorkel tube shown herein is of an exemplary nature only and is not to be considered limiting of the invention. Furthermore, it will be understood that although the present invention has been disclosed as a device which may be added to existing snorkel tubes, the invention also contemplates the use of the disclosed structure in an integral configuration within a snorkel tube, whereby the end of the snorkel tube is configured in the manner described herein during fabrication, thus obviating the need for adding a deflection device hereof at a later stage. Accordingly, all such modifications and additions are deemed to be within the scope of the invention, which is to be limited only by the claims appended hereto and their equivalents.

I claim:

1. A splash-guard addition for snorkel tubes to reduce entry of water into a top aperture of a snorkel tube and along the axis of such tubes; the splash-guard addition comprising:

a hollow-cylindrical body having a top end and a bottom end, the bottom end being adapted for attachment to a top end of snorkel tube in fluid communication with a top aperture of a snorkel tube, said splash-guard having a top aperture, and a flap integrally formed within said hollow-cylindrical body, said flap being below said top aperture of said splash-guard and spaced from said top and bottom ends of said hollow-cylindrical body and extending diagonally relative to and across a top aperture of a snorkel tube to redirect water entering said top aperture of said splash-guard opening away from a top aperture of a snorkel tube; and at least one channel in said hollow-cylindrical body extending from a first end adjacent said flap to a second end having an unobstructed opening to ambient below said flap, whereby water redirected by said flap exits said hollow-cylindrical body through said channel after being diverted away from a top aperture of an associated snorkel tube.

2. The addition recited in claim 1 wherein said hollow-cylindrical body and said flap comprise a unitary structure made of an injection-molded plastic.

3. The addition recited in claim 1 wherein said flap is in cantilevered relation to the interior of said hollow-cylindrical body.

4. The addition recited in claim 1 wherein said bottom end of said hollow-cylindrical body is adapted to encircle an exterior top portion of a snorkel tube in press fit engagement therewith.

5. The addition recited in claim 1 wherein said bottom end of said hollow-cylindrical body is adapted for insertion into a top aperture of a snorkel tube.

6. The addition recited in claim 5 wherein said bottom end of said hollow-cylindrical body comprises means for interlocking engagement with a snorkel tube.

7. An apparatus in combination with a snorkel tube having a top aperture for reducing the amount of water entering the top aperture of the snorkel tube; the apparatus comprising:

a housing having at least two separated channels including a first channel in fluid communication with said top aperture of said snorkel tube and a second channel having an unobstructed opening to ambient adjacent the outside of said snorkel tube; and a deflector positioned above said top aperture and relative to said first and second channels for deflecting water entering said first channel away from said top aperture of said snorkel tube and into said second channel.

8. The apparatus recited in claim 7 wherein said housing and said deflector comprise a unitary integrated structure made of injection-molded plastic.

9. The apparatus recited in claim 7 wherein said deflector is in cantilevered relation to the interior of said housing.

10. The apparatus recited in claim 7 further comprising means for attaching said housing to a snorkel tube adjacent the top aperture of said snorkel.

11. In combination a snorkel and a splash-guard for the snorkel, the snorkel comprising:

an elongated hollow tube having an axis and terminating in an aperture at a first end and a mouthpiece at a second end and forming a main channel therebetween;

said splash-guard having a bottom end in fluid communication with said main channel and a deflection channel separated from said main channel having an upper end adjacent said aperture and a lower end open to ambient, and a deflector positioned in said splash-guard above and spaced from said aperture to direct water ejected from said tube through said aperture toward said deflection channel and oriented to intercept water entering said splash-guard and to divert such water away from said main channel and into said deflection channel.

12. The snorkel recited in claim 11 wherein said deflector is oriented at a diagonal direction relative to the axis of said tube at said aperture.

* * * * *